United States Patent [19]

Wankel

[11] Patent Number: 4,540,356

[45] Date of Patent: Sep. 10, 1985

[54] INTERNAL AXIS CRANKLESS ROTARY PISTON ENGINE

[76] Inventor: Felix Wankel, Bregenzer Strasse 82, D-8990 Lindau, Fed. Rep. of Germany

[21] Appl. No.: 469,624

[22] Filed: Feb. 25, 1983

[30] Foreign Application Priority Data

Mar. 3, 1982 [CH] Switzerland ..... 1302/82

[51] Int. Cl.[3] ..... F01C 1/10; F01C 21/02

[52] U.S. Cl. ..... 418/164; 417/462

[58] Field of Search ..... 123/44 D; 417/462; 418/164; 91/196

[56] References Cited

U.S. PATENT DOCUMENTS

| | | | |
|---|---|---|---|
| 883,271 | 3/1908 | Wilson | 417/462 |
| 3,954,355 | 5/1976 | Paul | 418/164 X |
| 4,137,019 | 1/1979 | Hofmann | 417/462 |

FOREIGN PATENT DOCUMENTS

| | | | |
|---|---|---|---|
| 10382 | 4/1879 | Fed. Rep. of Germany | 417/462 |
| 699821 | 7/1932 | France | 417/462 |
| 1197958 | 7/1970 | United Kingdom | 418/164 |

*Primary Examiner*—Michael Koczo

*Attorney, Agent, or Firm*—Toren, McGeady, Stanger, Goldberg & Kiel

[57] ABSTRACT

An internal axis crankless rotary piston engine with an internal rotor and an external rotor mounted eccentrically to one another, with a circularly curved path of the external rotor mounting surrounding an internal rotor shaft, wherein the path of an external rotor bearing is mounted by a plurality of bearings which are spaced from one another in the direction of movement and which are fixed relative to the geometrical axis of the internal rotor shaft.

7 Claims, 7 Drawing Figures

INTERNAL AXIS CRANKLESS ROTARY PISTON ENGINE

BACKGROUND OF THE INVENTION

The invention relates to an internal axis crankless rotary piston engine including two rotors mounted eccentrically to one another, one being an external rotor having a mounting with a circularly curved path surrounding a shaft of an internal rotor cooperating therewith.

Rotary piston engines of the aforementioned type are known in the prior art, for example, from U.S. Pat. Nos. 724,665 and 3,954,355, as well as from British Pat. No. 961,872. In the case of an engine of the aforementioned type, the construction principle necessarily involves the path of the two bearings of the external rotor having a relatively large diameter because it surrounds the internal rotor shaft arranged eccentrically thereto unless, in a disadvantageous manner, both rotors are mounted on only one side. The rotor bearings of the known engines are constructed as friction bearings, so that radially they have only a small size. Due to the relatively large diameter of the external rotor bearing, correspondingly high bearing speeds occur, so that known machines can only be used for relatively low rotational speeds and are subject to relatively high friction losses. The use of conventional antifriction bearings for mounting the external rotor would lead to a structurally disadvantageous increase in the radial size of the bearing or to a further increase in the path thereof. In addition, the rotational speed of the engine would be relatively limited, because the large diameter of the path would lead to a correspondingly high rotational speed of the antifriction bearing bodies.

The problem sought to be overcome by the present invention is to obviate the aforementioned disadvantages of known engines, so that they can be operated at much higher rotational speeds and as a result of their small dimensions, they can be used in new fields, e.g. as superchargers or drivers for combustion engines. A further constructional problem sought to be overcome by the invention is to provide the ability to arrange the internal rotor shaft with a greater eccentricity relative to the external rotor and/or to enable it to have a larger diameter.

SUMMARY OF THE INVENTION

The present invention seeks to overcome the problems of the prior art by providing an engine wherein the path of the external rotor bearing is mounted by a plurality of bearing means which are spaced from one another in the direction of movement and which are fixed relative to the geometrical axis of the internal rotor shaft.

As a result of the inventive arrangement of a plurality of bearing means in juxtaposed manner in the direction of movement, the internal rotor shaft can be arranged between said bearing means, so that they are positioned radially further towards the outside. The shaft can itself form one of the bearing means, in that the bearing path rolls on the circumference of the shaft or a ring surrounding the latter. The bearing means preferably comprise rollers, which can be mounted by ball bearings.

Preferably, the external rotor bearing is arranged in the axial direction of the engine between its rotors and a driving connection between the rotors, the individual bearing means being carried by a sealing member, which is rigidly connected to the fixed outer engine casing and which extends into the space surrounded by the external rotor bearing path and up to the lateral surface of the internal rotor and is radially sealed with respect to the external rotor. Due to the fact that the sealing member brings about a radial seal with respect to the external rotor and/or due to the fact that the annulus formed by the conventional hollow gear of the external rotor is avoided, it is not necessary for the lateral surface of the internal rotor through a suitable size of the latter to cover such a cavity in all positions of its movement. Consequently, it provides a seal towards the working space of the engine. The arrangement of a driving connection provided by a pinion engaging in a hollow gear between both rotors in the axial external direction or the arrangement of the bearing in the axial direction between the driving connection of the internal rotor has the further advantage that the cavity of the external rotor can be given a smaller diameter for the passage of the internal rotor shaft than the diameter of the hollow gear of the external rotor.

As indicated hereinbefore, the internal rotor shaft diameter can be advantageously made larger through the arrangement of the shaft between two circumferentially juxtaposed bearing means. However, this does not simultaneously make it possible to increase the shaft diameter at the point at which the driving connection pinion is positioned between the two rotors, because the pinion diameter is determined by the eccentricity between the two rotors and the necessary transmission ratio. However, in order to be able to make the shaft diameter larger at this point, e.g. so that it can be constructed as a hollow shaft for cooling the internal rotor, the drive transmission between the pinion and the hollow gear of the external rotor takes place by means of two intermediately connected gears or an intermediately connected annular gear with internal and external teeth. It is obvious that in this case, the hollow gear of the external rotor is given a correspondingly larger diameter.

It is clear that the present invention can be advantageously used in all rotary piston engines of the aforementioned type, because the internal axis construction requires an external rotor having a relatively large bearing path diameter, so that correspondingly high speeds occur on said path.

Instead of constructing the bearing means in the form of rollers, it is also possible to use different bearing means, such as e.g. individual magnetic bearings, individual air cushion bearings, etc. The supporting rollers can also be used for the lateral guidance of the external rotor, i.e. they can also absorb forces acting axially on said external rotor, provided that they have a flange or a groove cooperating with a groove or flange of the external rotor path.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF PREFERRED EMBODIMENTS

Figure 1:
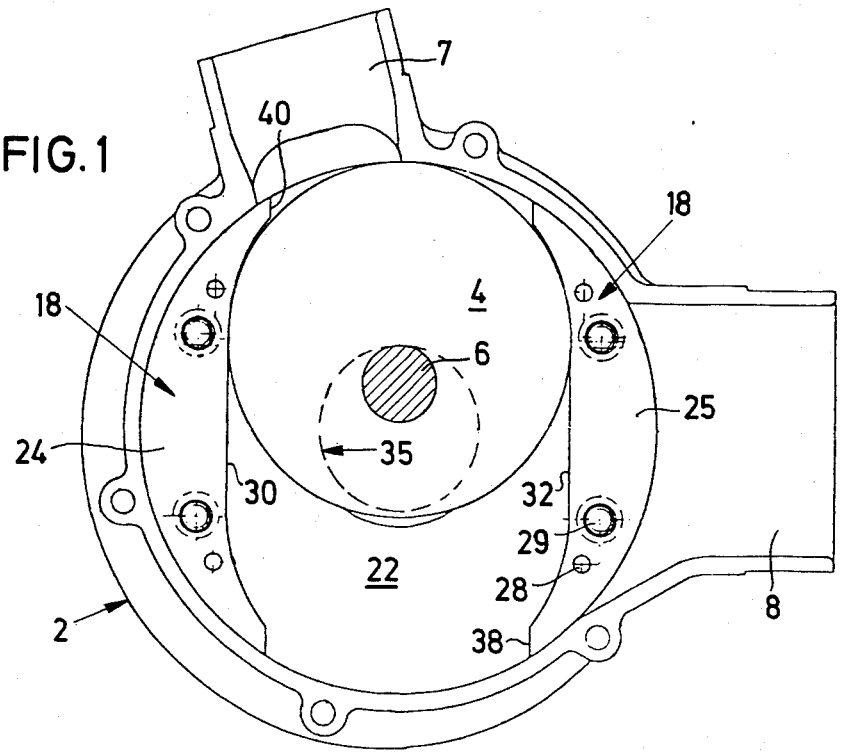
FIG. 1 is a radial cross-section through a rotary piston engine in accordance with the invention.
Figure 2:
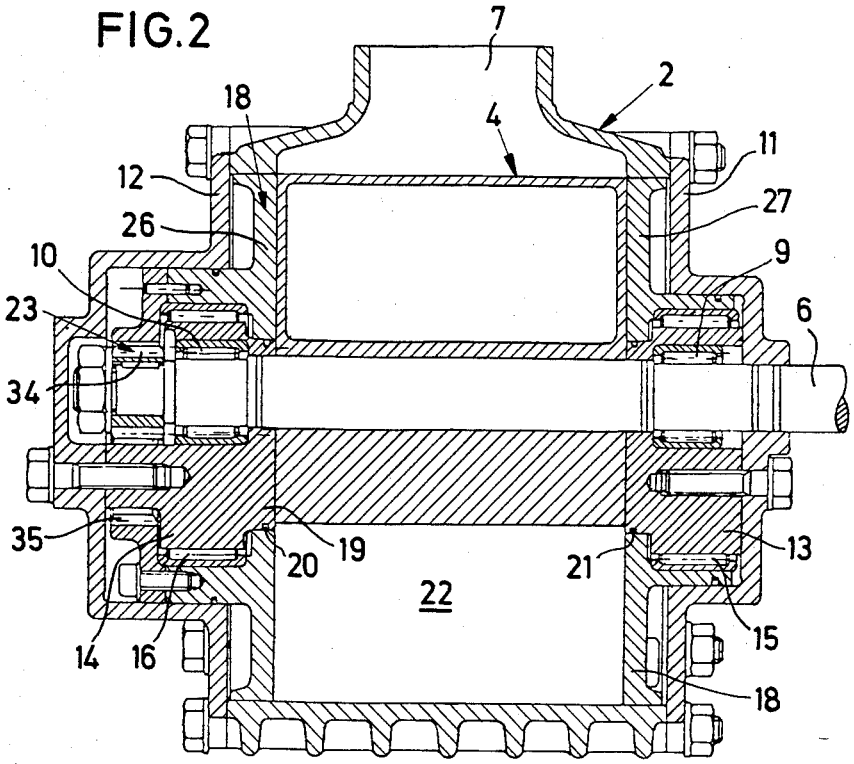
FIG. 2 is an axial section through the engine according to FIG. 1 with a sealing member, but with an external rotor bearing not in accordance with the invention.

Referring now to the drawings wherein preferred embodiments of the invention are depicted, FIG. 1 shows an internal axis rotary piston engine 2 which is structured in view of the present invention to be particularly suitable for use as a driver and/or supercharger of a combustion engine. The engine 2 includes an internal rotor 4 having a circular cross-section which rotates eccentrically about a main shaft 6 of the engine which has a fixed rotational axis, e.g., fixed relative to the engine casing. In the represented embodiment, the shaft 6 is mounted by means of two antifriction bearings 9, 10 in sealing members 13, 14 rigidly connected to lateral casing covers 11, 12. The internal rotor 4 through its rotation about the fixed axis shaft 6 can be completely balanced so that no centrifugal forces act on the bearing and consequently very high rotational speeds are possible.

A second bearing 15, 16 provided in each case on the outer circumference of sealing members 14, 13 is used for mounting of an external rotor 18 about its fixed central axis. Due to the larger diameter of bearings 15, 16 and the relatively small diameter of the roller members thereof, these bearings are exposed to high rolling speed and therefore high stresses, which are avoided according to the present invention.

A packing 20, 21 is provided between side walls 26, 27 of the external rotor 18 facing a working space 22 of the engine and a part 19 of the sealing members 13, 14 projecting into the same ensures that the bearings 9, 10, 15, 16 and a drive transmission 23 between the internal and external rotors, come into contact with the medium flowing through the engine. Flow takes place through the connections 7, 8 provided radially and externally on the engine casing.

The external rotor 18 surrounding the internal rotor 4 comprises two facing crescent-shaped circumferential parts 24, 25 and two lateral parts 26, 27 enclosing therebetween the parts 24, 25. The interconnection of these parts is provided by pins 28 and bolts 29. The facing inner surfaces 30, 32 of the external rotor run parallel to one another, so that the internal rotor 4 can perform a reciprocating movement in the working space 22 defined by these surfaces. This relative linear movement of internal rotor 4 with respect to external rotor 18, despite the rotary movement of both rotors, results from the kinematics of the systems as is evident to those skilled in the art. Internal rotor 4 which also can be considered as a rotary piston, is in each case in meshing engagement with two gaps of the external rotor, so that it rotates at double the speed of the latter. Thus, the transmission ratio is 1:2, so that the pitch circle of a pinion 34 of the drive transmission 23 between the internal and external rotors has half the diameter of the pitch circle of a hollow gear 35.

Figure 4:
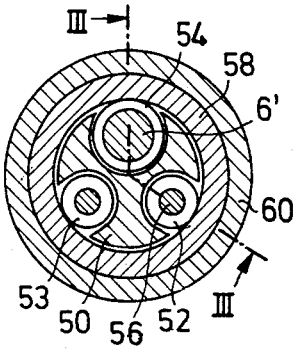
FIG. 4 is a radial cross-section along line IV—IV of FIG. 3.
Figure 5:
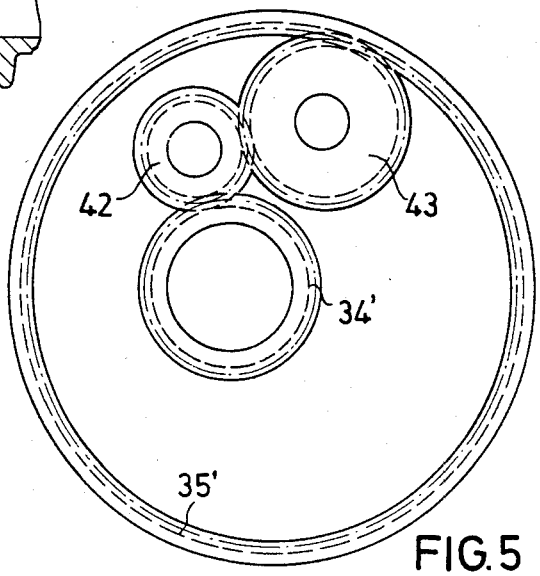
FIGS. 5 and 6 are diagrammatic views of two embodiments of a driving connection between the internal and external rotors.
Figure 7:
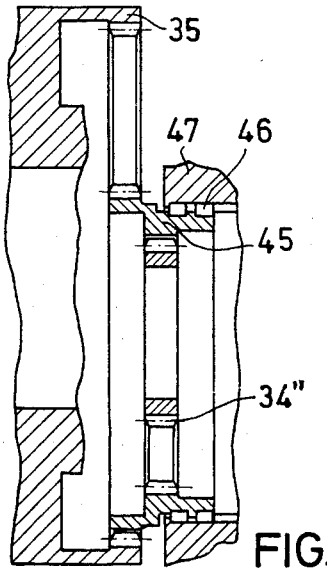
FIG. 7 is an axial partial section related to the driving connection of FIG. 6.
Figure 6:
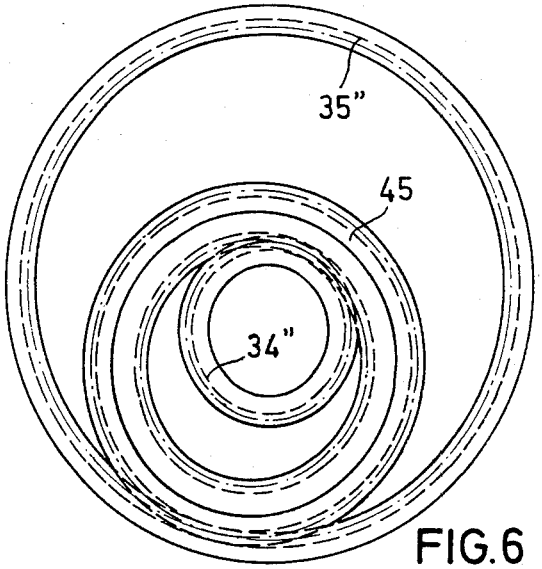

However, FIGS. 5 to 7 show that the transmission ratio of 1:2 can also be achieved in other ways. In order—in the case of the same spacing of the axis of shaft 6 from the axis of the external rotor and with the same transmission ratio—to obtain a larger diameter of shaft 6 and a correspondingly larger diameter of pinion 34 (so that shaft 6 can be made hollow for cooling of the internal rotor 4 in a manner shown and/or to obtain a greater strength for a larger axial length of the rotor, according to the diagrammatic views of FIGS. 5 and 6) it is possible to provide at least two intermediate gears between pinion 34′, 34″ and outer hollow gear 35′, 35″. In the case of FIG. 5, the drive transmission between the pinion and the hollow gear takes place by means of two intermediate gears 42, 43 of different size, whereas in FIG. 6 a hollow gear 45 with internal and external teeth is positioned between pinion 34″ and hollow gear 35″. Hollow gear 45 is mounted relative to the engine casing or a part 47 connected thereto by means of a bearing 46 as shown by the axial partial cross-section of FIG. 7. It is obvious that bearing 46 can be constructed according to the same principle as the bearing of the external rotor in accordance with FIGS. 3 and 4, in which case the rollers would be mounted in casing part 47.

Figure 3:
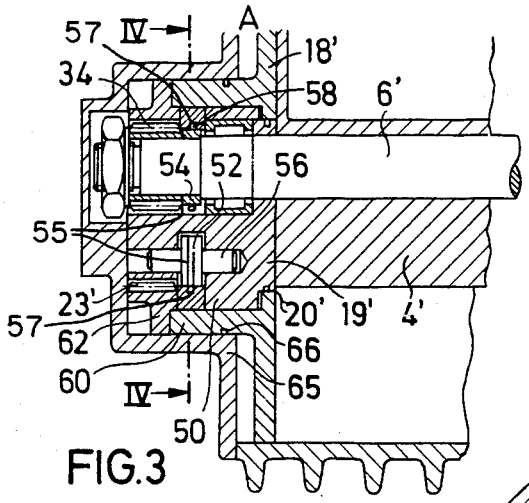
FIG. 3 is an axial partial cross-section along line III—III of FIG. 4 through a rotary piston engine having a bearing according to the invention.

FIGS. 3 and 4 show an embodiment according to the invention in which the external rotor 18′ is mounted by three rollers 52, 53, 54, which are themselves mounted on a sealing member 19′. Two of the rollers 52, 53 are mounted in a sealing member 50 by a journal 56, with the third roller being mounted on shaft 6. The rollers 52 to 54, which are made from a hardened material, roll on a hardened steel ring bearing 58 which is placed in a lateral hub part 60 of the external rotor. A lateral end face of a hollow gear 62 ensures the axial position of the ring bearing 58. The arrangement of ring bearing 58 and bearing rollers 52 to 54 which roll thereon, immediately alongside a gear 23′ ensures good lubrication by the lubricant supplied to the gear.

In place of a roller 54 arranged on shaft 6′, it is also possible to fix a ring 54 to the latter, provided that its diameter is the same as the pitch circle diameter of pinion 34, so that in the case of a speed ratio of 1:2, there is a slip-free rolling on the radially inner path of ring bearing 58.

Between the outer circumference of the hub part 60 of the external rotor 18′ carrying ring bearing 58 and the lateral casing part 65 there is provided a packing ring 66 which ensures sealing of that part of the engine provided with the lubricant, together with the packing 20 on sealing member 19′.

Rollers 52 to 54 can be provided with a cross-sectionally small, rotary web or flange 55, which engages in a correspondingly shaped groove 57 in ring bearing 58, so that guidance is provided against axial displacement between the shaft and external rotor.

Thus, it will be seen that the present invention provides an internal axis rotary piston engine, whose external rotor and internal rotor rotated about fixed axes, and whose hub part surrounding the internal rotor shaft is filled by a sealing member, which borders on the lateral surface of the internal rotor. The internal rotor shaft is mounted in this sealing member and the sealing member is also used for mounting the rollers, on whose circumference rolls the ring bearing connected to the hub part of the external rotor. The rollers have a much larger diameter and therefore a lower rotational speed than the bearing members of a conventional antifriction bearing. The mounting of the external rotor by individual rollers makes it possible to arrange the internal rotor shaft in the circumferential direction between two rollers, so that its circumference can bound the external rotor ring bearing path and can also fulfill the function of a roller.

While specific embodiments of the invention have been shown and described in detail to illustrate the application of the inventive principles, it will be understood that the invention may be embodied otherwise without departing from such principles.

What is claimed is:

1. An internal axis crankless rotary piston engine comprising:

an engine casing (2, 65);

an internal rotor (4') and an external rotor (18') eccentrically mounted within said casing (2, 65) for rotation about axes which are fixed relative to said casing;

external rotor mounting means (60, 58) including circularly curved ring bearing means (58) rotatively mounting said external rotor;

an internal rotor shaft (6') on said internal rotor (4') rotatively mounted relative to said casing (2, 65);

said circularly curved ring bearing means (60, 58) of said external rotor mounting means surrounding said internal rotor shaft and being mounted by a plurality of individual bearing means (52, 53, 54) which are spaced from one another circumferentially relative to the ring bearing means (60, 58) within said ring bearing means (60, 58) and which are fixed relative to said casing (60, 58).

2. A rotary piston engine according to claim 1, wherein said internal rotor shaft is arranged between two of said individual bearing means.

3. A rotary piston engine according to claim 1, wherein said individual bearing means are rollers which roll on said ring bearing means.

4. A rotary piston engine according to claim 1, wherein said internal rotor shaft comprises one of said individual bearing means, said ring bearing means being carried on one of the circumference of said internal rotor shaft and a ring surrounding said shaft.

5. A rotary piston engine according to claim 1 including a sealing member having a radial packing with respect to said external rotor, a driving connection between said rotors and said engine casing, wherein said internal rotor comprises a lateral surface, wherein said ring bearing means in the axial direction of the engine is arranged between said internal rotor and said driving connection between said rotors, wherein said individual bearing means are carried by said sealing member, and wherein said sealing member is rigidly connected to said fixed outer engine casing and extends into the space surrounded by said external rotor bearing means up to said lateral surface of said internal rotor.

6. A rotary piston engine according to claim 1, further comprising a driving connection between both rotors having a hollow gear, and a pinion carried on said internal rotor shaft which is in driving connection with said hollow gear, said driving connection being one of a direct connection and a connection via at least one intermediate gear.

7. A rotary piston engine according to claim 3, wherein said rollers of said individual bearing means have a flange which engages in said rollers.

* * * * *